US005676761A

United States Patent [19]

Gormanos et al.

[11] Patent Number: 5,676,761

[45] Date of Patent: Oct. 14, 1997

[54] SYSTEM AND METHOD FOR ROUGH CLEANING AN ANODE ASSEMBLY

[75] Inventors: John T. Gormanos, Spokane; A. Mark Via, Mead; Patrick M. Paul, Spokane; Ernest P. Masiero, Spokane; Lynn E. Tower, Spokane, all of Wash.

[73] Assignee: Kaiser Aluminum and Chemical Corporation, Pleasanton, Calif.

[21] Appl. No.: 594,128

[22] Filed: Jan. 31, 1996

[51] Int. Cl.[6] ..... B08B 7/09; B08B 7/04

[52] U.S. Cl. ..... 134/6; 134/16; 134/62; 15/93.1; 15/94; 15/309

[58] Field of Search ..... 134/2, 6, 9–32, 134/33, 42, 16, 61, 62; 15/93.1, 94, 308, 309, 89

[56] References Cited

U.S. PATENT DOCUMENTS

| | | | |
|---|---|---|---|
| 3,094,437 | 6/1963 | Scheer | 134/16 |
| 4,007,533 | 2/1977 | Brandon et al. . | |
| 4,119,505 | 10/1978 | Baillot et al. . | |
| 4,217,197 | 8/1980 | Harder et al. . | |
| 4,418,435 | 12/1983 | Arnold | 15/4 |
| 4,442,593 | 4/1984 | Holmberg . | |
| 4,469,281 | 9/1984 | Reed . | |
| 4,501,044 | 2/1985 | Schulze et al. . | |
| 4,510,033 | 4/1985 | Martin et al. . | |
| 4,724,589 | 2/1988 | Walker | 15/94 |
| 5,220,935 | 6/1993 | Bailey et al. | 134/102.1 |

FOREIGN PATENT DOCUMENTS 2100754 1/1983 United Kingdom .

OTHER PUBLICATIONS

Marketing brochure for "Bath Material Removal and Crushing" from Kaiser Aluminum Europe (no date available).

Marketing brochure for "Anode Butt Bath Cleaning System" from Aisco Systems, Inc. (no date available).

*Primary Examiner*—Jeffrey Snay
*Assistant Examiner*—Alexander Markoff
*Attorney, Agent, or Firm*—Lee & Hayes, PLLC

[57] ABSTRACT

An anode rough cleaning system has three rough cleaning stations and an overhead conveyor to move spent anode assemblies sequentially through the three stations. The overhead conveyor supports each spent anode assembly in a hanging vertical position with the carbon butt suspended therebeneath. A first station is a vibrating station which vibrates the carbon butt to separate the bath material from the carbon butt. The vibrating station has an inclined surface and a vibrating surface. The overhead conveyor is arranged over the inclined and vibrating surfaces to drag the carbon butt up the inclined surface, causing the spent anode assembly to rotate from the vertical position to an angled position, and then across the vibrating surface with the spent anode assembly in the angled position. A second station is a scraping station positioned downstream of the vibrating station. The scraping station has at least one scraper to scrape the bath material from the carbon butt and stub. A third station is a blow-off station positioned downstream of the scraping station. The blow-off station has at least one pressurized gas port directed to blow the bath material off of the carbon butt.

20 Claims, 4 Drawing Sheets

60
62
64
20
38
36
90
80
82
94
92
34
68

SYSTEM AND METHOD FOR ROUGH CLEANING AN ANODE ASSEMBLY

TECHNICAL FIELD

This invention relates to systems and methods for rough cleaning an anode is used in the production of aluminum.

BACKGROUND OF THE INVENTION

Aluminum is produced in a chemical reduction process which converts alumina (aluminum oxide) into aluminum and oxygen. The reduction process is performed in a large aluminum reduction cell which includes a container or "pot" lined with refractory and carbon. Within the pot is a molten mixture of alumina dissolved in cryolite and other materials, such as various fluorides, which are generally referred to as "bath." One or more sacrificial carbon anodes are lowered from above the reduction cell into the molten mixture. The pot and a metal pad of molten aluminum, which collects at the bottom of the pot, form an associated cathode.

A voltage potential is applied between the carbon anodes and the pot, resulting in a large current flow from the anodes, through the molten bath mixture, to the pot. The magnitude of this current is typically over 60,000 Amperes. The electrical current passing through the bath mixture reduces the alumina into its aluminum and oxygen components. The aluminum drops under gravity to the bottom of the pot, forming the metal pad. The oxygen combines with the carbon from the anodes and escapes as carbon dioxide gas, which is vented from the pot. As the alumina is consumed, more alumina is added to the bath in the cell.

During the aluminum reduction process, the carbon anodes are consumed. As a result, the spent anodes are routinely replaced by fresh anodes so that the aluminum production can continue in an efficient manner.

FIG. 1 shows a conventional anode assembly 10 before introduction to the aluminum reduction cell, and a spent anode assembly 20 after consumption in the reduction process. The new anode assembly 10 has a straight copper or aluminum rod 12, an iron or steel stub 14, and a carbon anode 16. Before consumption, the carbon anode 16 is a rectangular block with a height profile dimension typically of approximately 18 to 24 inches.

In the spent anode assembly 20, the carbon butt 22 is substantially consumed. Typically, an expended carbon butt 22 has a height profile dimension of approximately 4 to 8 inches. The spent anode assembly 20 also has cryolite or other bath material 24 crusted onto the partly consumed carbon butt 22. The crusted bath material 24 is the result of covering carbon with bath and alumina during pot operation. Removing the anode assembly from the reduction cell at the end of its cycle also removes a portion of crusted bath material 24.

More particularly, during the aluminum reduction, the bath mixture is maintained in a molten state. However, an upper layer of bath material cools in the atmosphere surrounding the anode assembly to form a crusted upper layer. This solid bath layer acts as an insulator to efficiently retain heat within the pot. When it is time to replace the spent anode assembly, the crusted layer is physically broken to extract the carbon butt from the molten mixture. During removal, some of the crusted bath material remains on the carbon butt, with most of the bath material being attached on the upper surface of the carbon butt.

The spent anode assembly 20 is sent to a rodding room which removes the consumed carbon butt 22 from the stub 14, and mounts a new carbon anode 16 onto the stub 14. The remaining carbon butt 22 is recycled and used to produce a new carbon anode. Additionally, the crusted bath material 24 is recovered and used in the reduction process.

Aluminum manufactures attempt to separate the crusted bath material 24 from the carbon butt 22 so that both materials can be recycled. The separation process is typically performed mechanically. The use of chemicals to separate the bath and carbon has proven difficult because the by-product must likewise be separated, which is an equally daunting task.

One conventional technique for separating the bath material from the carbon butt is to use mechanical scrapers which physically scrape the bath material. U.S. Pat. No. 4,418,435 describes a four station system, which includes a scraper station, two jackhammer stations positioned before and after the scraper station, followed by a brushing station. The jackhammer stations break or loosen the bath (cryolitic material) from the carbon butt. The intermediate scraper station has a rotating scraper comprised of blades attached to a continuous loop chain to scrape the bath from the carbon butt. The brushing station has a rotary wire brush to clean the loosened bath from the top surface of the carbon butt.

Another cleaning technique is a two stage cleaning system manufactured by Aisco Systems, Inc. of Burlington, Ontario, Canada. This system includes a jackhammer station followed by a shot blast fine cleaning station. The shot blast station blows pressurized gas onto the carbon butt to remove the bath material loosened by the jackhammers.

Another bath removal process, which was developed by Kaiser Aluminum Europe, Inc., applies free falling steel balls to clean the bath material from the carbon butt. The carbon butt is rotated under a flow of falling steel balls, which are dropped approximately 5 meters overhead. The steel balls collide with the bath material to break it away from the carbon butt.

While these techniques have proven effective, there is a continuing desire to improve the rough anode cleaning process.

SUMMARY OF THE INVENTION

This invention concerns an improved system and method for cleaning a spent anode assembly. According to one aspect, an anode rough cleaning system has three rough cleaning stations and an overhead conveyor to move the spent anode assembly sequentially through the three stations. The overhead conveyor supports the spent anode assembly in a hanging vertical position with the carbon butt suspended therebeneath.

The first station is a vibrating station which shakes the carbon butt to separate the bath material from the carbon butt. The vibrating station has an inclined surface leading to a vibrating surface. The overhead conveyor is arranged over the inclined and vibrating surfaces. The conveyor drags the spent anode assembly up the inclined surface, causing the assembly to rotate from the vertical position to an angled position, and then across the vibrating surface. Alternatively, the vibrating surface may convey the spent anode assembly.

The second station is a scraping station positioned downstream of the vibrating station. The scraping station has at least one scraper to scrape the bath material from the carbon butt and stub. In one implementation, the scraping station employs adjustable scrapers that are mechanically moved in a manner to scrape bath material from the surfaces of the carbon butt and stub areas.

The third station is a blow-off station positioned downstream of the scraping station. The blow-off station has at least one pressurized gas port directed to blow the loose bath material off of the carbon butt.

According to another aspect of this invention, a method for cleaning a spent anode assembly includes transporting a spent anode assembly to a first processing station and vibrating the carbon butt at the first processing station to loosen and separate the bath material from the carbon butt. The spent anode assembly is then transported from the first processing station to a second processing station where it is scraped. Thereafter, the spent anode assembly is transported from the second processing station to a third processing station where a compressed gas is blown onto the carbon butt to further remove the bath material.

DETAILED DESCRIPTION OF THE PREFERRED EMBODIMENT

Figure 1:
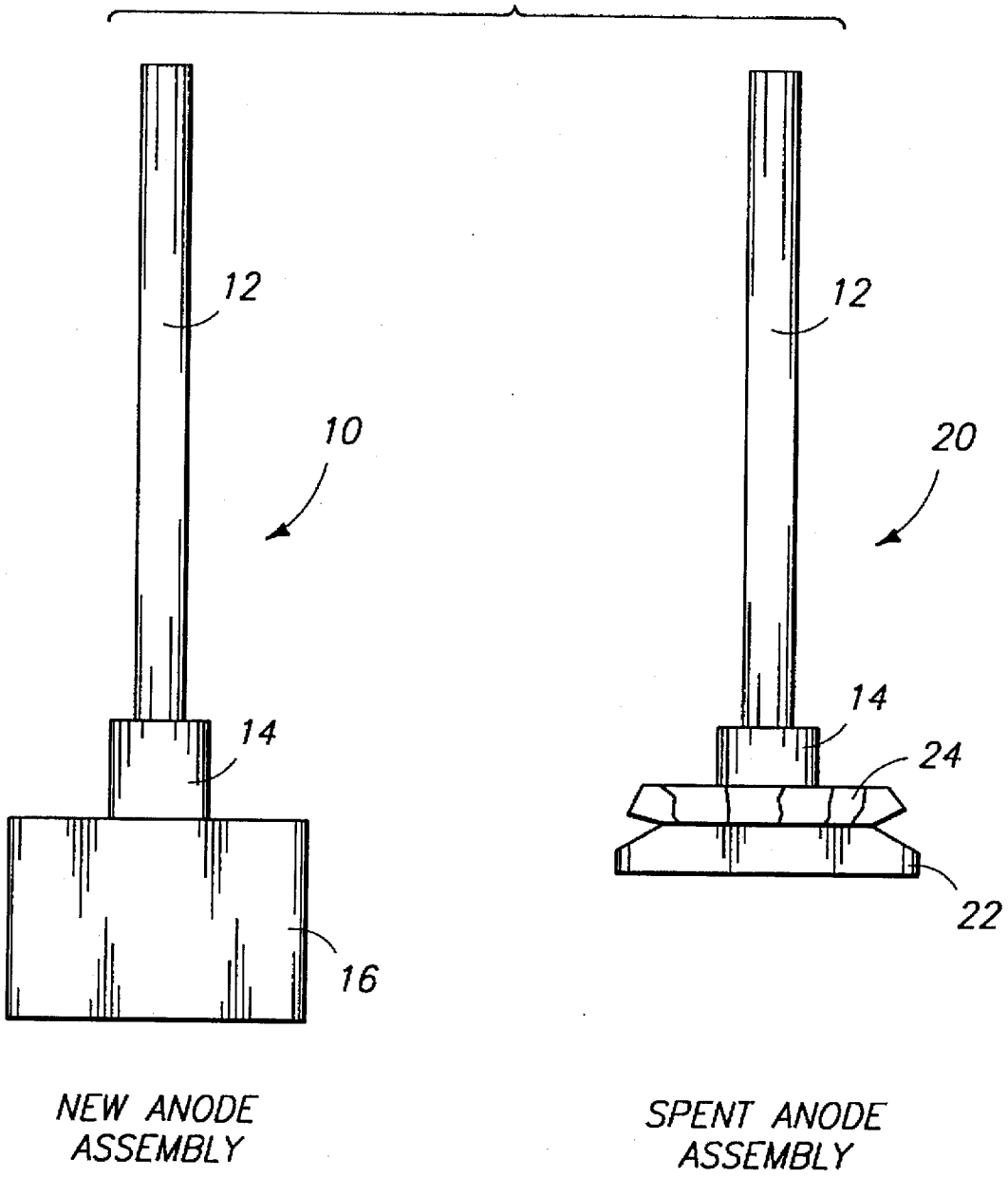
Fig 1 Prior Art
FIG. 1 is a diagrammatic illustration of a side view of a conventional anode assembly, before and after use in the aluminum reduction process.
Figure 2:
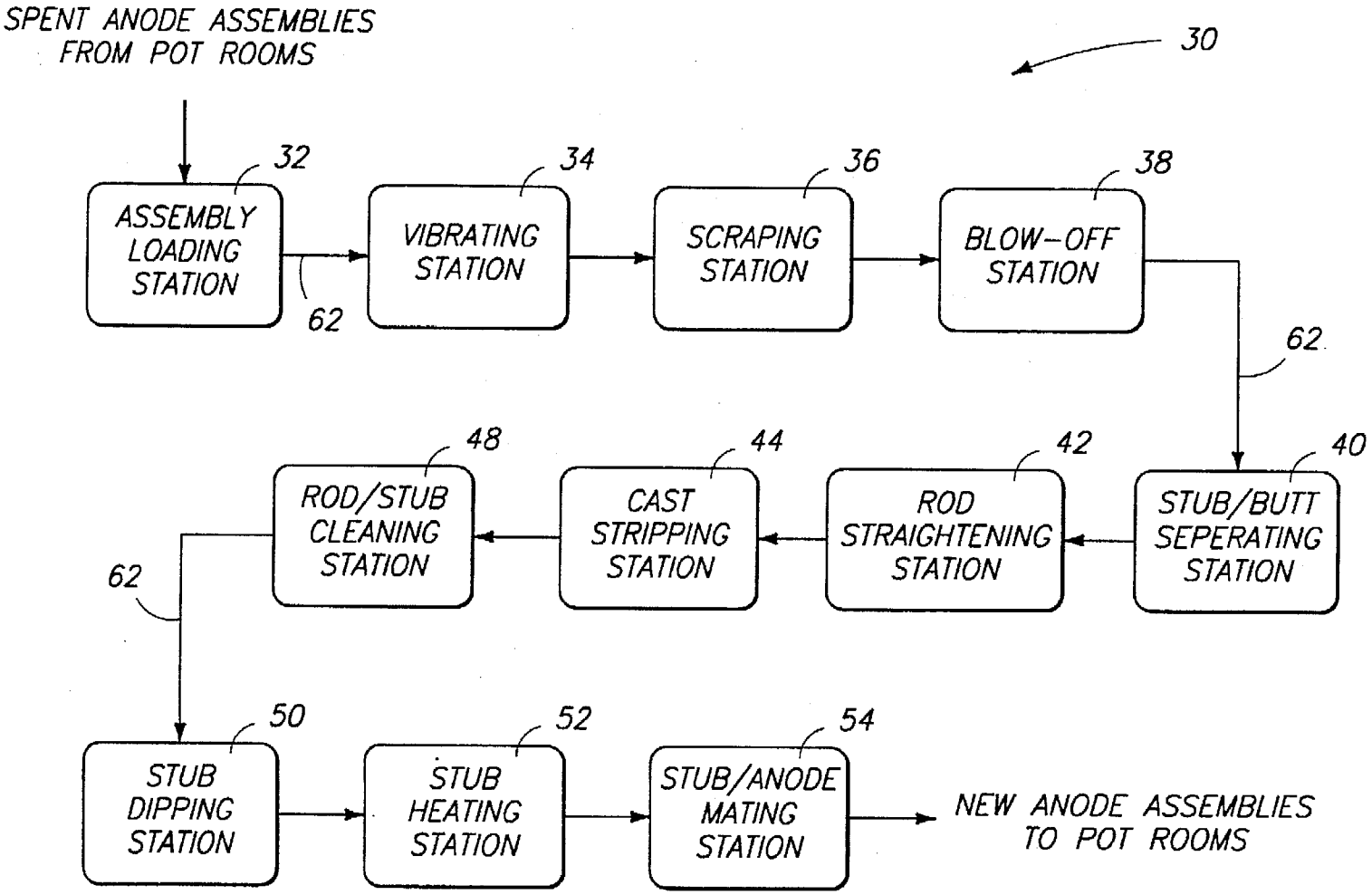
FIG. 2 is a block diagram of a rodding room. This figure shows various stations and an example production flow in the process of converting spent anode assemblies to new anode assemblies.

FIG. 2 shows the layout of a rodding room 30 arranged according to an aspect of this invention. The rodding room is a place where spent anode assemblies are converted to new anode assemblies. It is typically a large room separate from the potrooms that house the potlines of many reduction cells. The spent anode assemblies are loaded manually or by machine into trailers in the pot rooms and conveyed to the rodding room 30.

Figure 4:
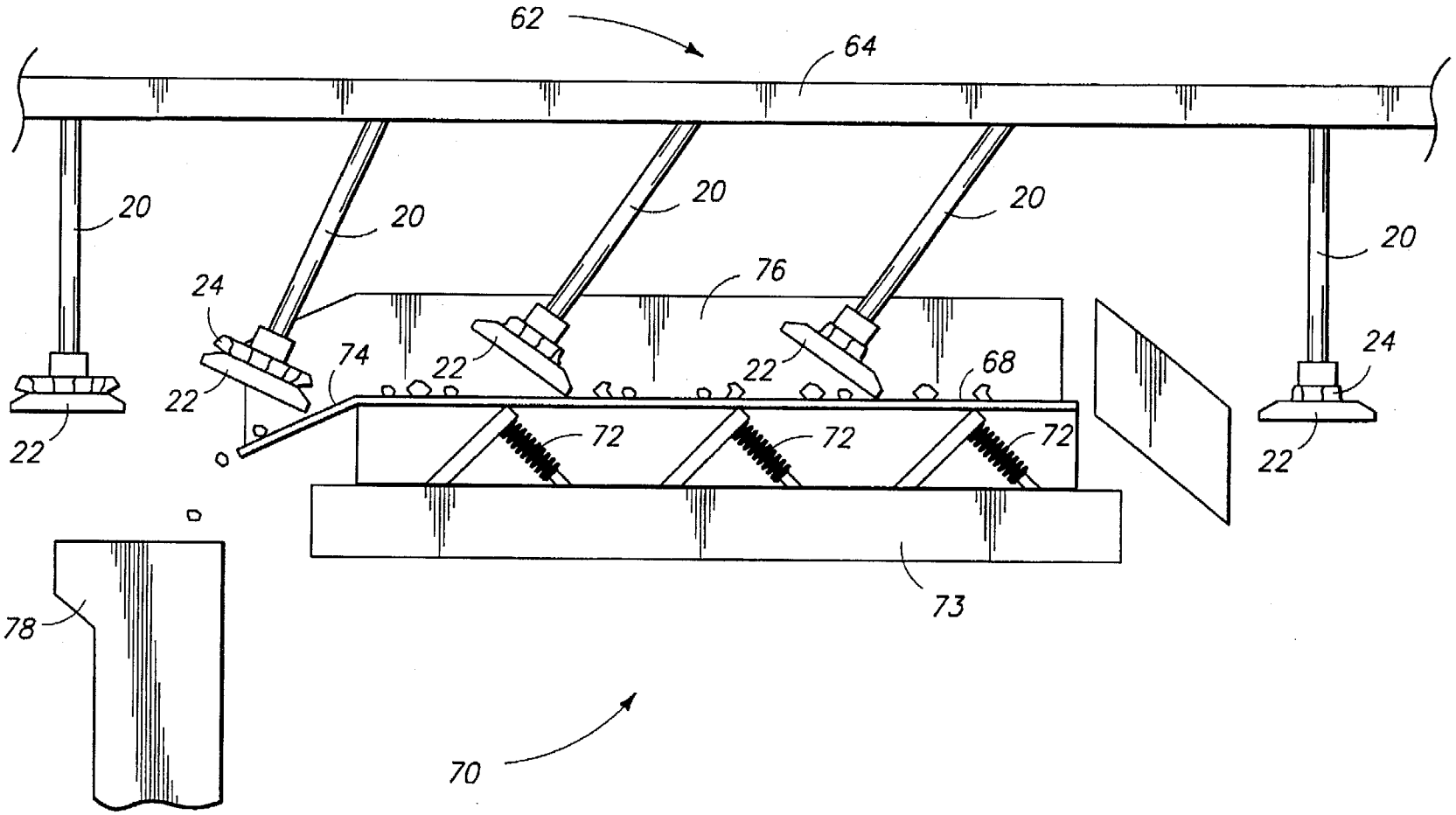
FIG. 4 is a diagrammatic illustration of a side view of an apparatus for removing bath material from a carbon butt of a spent anode assembly.

At the rodding room, the spent anode assemblies are unloaded from the trailers and loaded onto a conveyor system at an assembly loading station 32. In the described implementation, the conveyor system is an overhead conveyor system (referenced by number 62). The spent anode assemblies are hung from the conveyor system in a vertical position (as shown in FIG. 4), with the carbon butt suspended below a conveyor track.

The spent anode assemblies are first transported by the conveyor system to a vibrating station 34. Here, the anode assemblies are vibrated to initially loosen and separate the bath material from the carbon butt. Most of the bath material is removed at the vibrating station 34, and collected in a bin for recycling.

The anode assemblies are transported from the vibrating station 34 to a scraping station 36. Mechanical scrapers physically scrape the carbon butt and stub to remove more of the bath material. The conveyor system then transports the spent anode assemblies to a blow-off station 38. Compressed gas is blown onto the carbon butt to remove bath material from the carbon butt.

The vibrating station 34, scraping station 36, and blow-off station 38 form a anode rough cleaning system 60 that mechanically separates the bath material from the carbon butt, thereby cleaning the spent anode assemblies. Throughout the three stations, the bath material is collected and recycled for use in the reduction cells. The three-station system has been shown to provide at least 96% cleaning efficiency of the carbon butts.

After the anode assemblies have been cleaned, the overhead conveyor system moves them to a stub/butt separating station 40 where the carbon butt is broken away from the iron stub. The carbon is collected and crushed into small particles which are reused to build new rectangular blocks of carbon. The rod/stub assemblies are transported by the conveyor system to the rod straightening station 42 which reconditions the rod to remove any bends or twists. Thereafter, the rod/stub assemblies are ported to a cast stripping station 44 which removes a cast iron layer from around the stub. It is noted stations 42 and 44 can be reversed, whereby the cast iron layer is first removed from the stub and then the rod is straightened.

The rod/stub assembly is then taken by the conveyor system to a cleaning station 48 where the rod/stub assembly is more finely cleaned in preparation for being mated to a new carbon anode. The clean rod/stub assembly is transported to a stub dipping station 50 which coats the stub with a graphite, followed by a stub heating station 52 which preheats and dries the stub. The rod/stub assembly is finally transferred to a stub/anode mating station 54 where the heated stub is positioned in a pre-formed cavity in the carbon anode and molten cast iron is poured into the cavity to bond the stub to the carbon anode. The result is a new anode assembly which can be taken back to the potrooms for use in the aluminum reduction process, or stored for later use.

Figure 3:
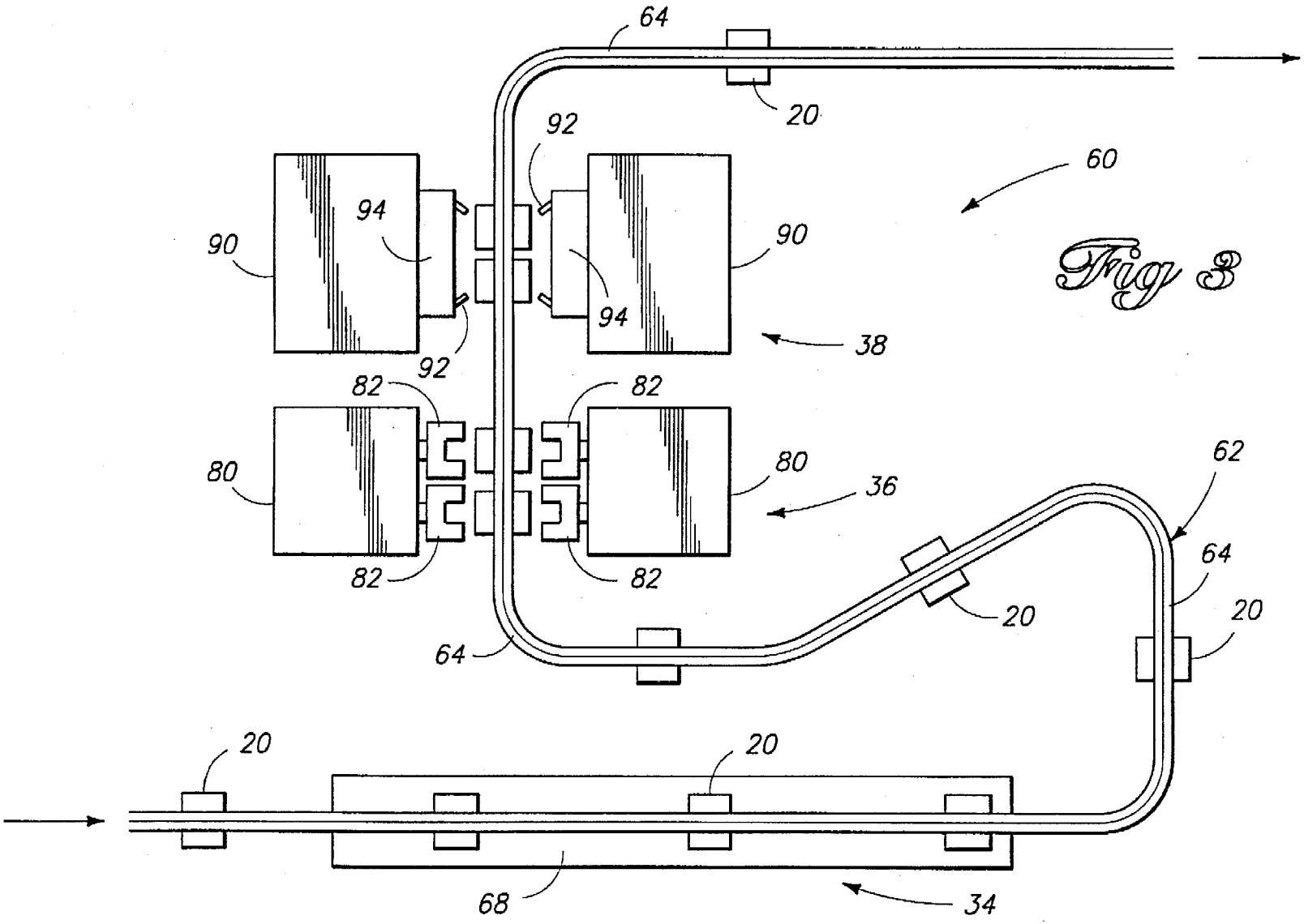
FIG. 3 is a diagrammatic illustration of a plan view of a anode rough cleaning system.

FIG. 3 shows an anode rough cleaning system 60 in more detail. The system 60 includes a conveyor system 62 with an overhead track 64. The spent anode assemblies, represented by rectangular blocks 20, are transported sequentially through the vibrating station 34, the scarping station 36, and the blow-off station 38 by the overhead conveyor system 62.

The vibrating station 34 has a vibrating floor or surface 68 in the form of a vibratory pan conveyor. The overhead conveyor 62 drags the carbon butts of the spent anode assemblies 20 across the vibrating surface 68. The vibrating action causes the bath material to separate from the carbon butt. Preferably, the spent anode assemblies are continuously moved through the vibrating station in a first or conveying direction (to the right in FIG. 3). The vibrating floor or surface 68 may convey the removed bath either counter to the direction of the anode assembly 20 or in the same direction.

FIG. 4 shows one implementation of a vibrating apparatus 70 located at the vibrating station 34. Apparatus 70 includes the vibrating surface 68, which is horizontal, but may be inclined or declined. The vibrating surface 68 is vibrated by a set of spring-loaded mounts 72 that are physically actuated by a motor (not shown). The spring-loaded mounts 72 are mounted to a stationary base 73. When actuated, the springs induce a continuous resonating or natural frequency vibration to the surface 68. The apparatus 70 has an inclined surface 74 leading to the vibrating surface 68. The inclined surface 74 is preferably integrally formed with the vibrating surface 68, so that it too vibrates. Alternatively, the inclined surface 74 is separate from the vibrating surface to remain mechanically isolated from the vibration.

The overhead conveyor track 64 is arranged over the inclined and vibrating surfaces. The spent anode assemblies 20 are supported from the conveyor system in a hanging vertical position, with the carbon butt 22 suspended below the conveyor track 64. The track 64 is spaced from the surface by a distance less than the length of the anode assembly 20. In this fashion, the conveyor system 62 drags the carbon butt 22 up the inclined surface 74, causing the spent anode assembly 20 to rotate from the vertical position to an angled position. The conveyor then drags the carbon butt 22 across the vibrating surface 68 with the spent anode assembly 20 remaining in the angled position.

During the vibration, bath debris is separated from the carbon butts and falls onto the vibrating surface 68. Side walls 76 (of which only the rearward wall is shown, with the forward wall removed for illustration purposes) retain the debris on the vibrating surface 68, and additionally prevent the carbon butts 22 from sliding off of the vibrating surface. The bath debris is ported by the vibrating surface 68 in a second direction opposite to the conveying direction toward a collection bin 78 for recycling.

With reference again to FIG. 3, the anode assemblies 20 are conveyed from the vibrating station 34 to the scraping station 36. The anode assemblies 20 are then temporarily halted at the scraping station 36. This is preferably accomplished by a timed release stop mechanism maintained in the conveyor track, or by diverting the anode assemblies through a separate side track, which allows the assemblies to pause from the continuous conveyor system.

A scraper apparatus 80, located at the scraping station 36, has a set of scrapers 82 which are mechanically maneuvered to scrape the bath material from the carbon butt. In the illustrated embodiment, the scraper apparatus 80 simultaneously scrapes two anode assemblies. First and second pairs of scrapers 82 are moved back and forth to scrape the bath from upper surfaces of the carbon butt and stub. A cut out portion of the scrapers 82 enables the dual prong blades to scrape around the stub supporting the carbon butt.

The reciprocal scraping action is preferably performed numerous times. The scraping process can be automated to scrub the carbon butt a set number of strokes. Alternatively, an employee can semi-automatically manipulate the scrapers 82 using a joystick controller or the like. The scrapers are vertically movable and rotatable to adjust to the upper surface of the carbon butt and to provide various scraping angles. The bath debris removed by the scraper apparatus falls to a collection bin (not shown) located beneath the conveying path.

After scraping, the spent anode assemblies 20 are moved to the blow-off station 38 where they are once again temporarily stopped. A pressurized gas cleaning apparatus 90, located at the blow-off station 38, has gas ports 92 which direct streams of compressed gas, such as air, onto the carbon butt. The blow-off apparatus also has a retractable hood consisting of first and second hood elements 94 which are mechanically moved to cover the gas ports 92 and to enclose carbon butts. Once enclosed, the pressurized streams of gas are sprayed onto the carbon butts to further remove any bath material. The blow-off cycle has a programmable time period. After the blow-off period, the hood elements 92 are mechanically retracted so that the rough cleaned anode assemblies can be conveyed to the next station in the rodding room. A dust collection system is provided at all three stations 34, 36, and 38 to capture any airborne particulates generated during the cleaning process.

It is noted that the entire anode rough cleaning system 60 is surrounded by an acoustical enclosure to dampen the sound created during the rough cleaning process.

The rough cleaning system and method of this invention have been shown to provide a cleaning efficiency in excess of 96%. The three-station system is efficient, and can be easily organized in a rodding room without consuming a large percentage of floor space. Additionally, the three-station system is serviced by the same rodding room conveyor system, so that the anode assemblies are automatically carried from station to station without use of manual labor.

In compliance with the statute, the invention has been described in language more or less specific as to structure and method features. It is to be understood, however, that the invention is not limited to the specific features described, since the means herein disclosed comprise exemplary forms of putting the invention into effect. The invention is, therefore, claimed in any of its forms or modifications within the proper scope of the appended claims appropriately interpreted in accordance with the doctrine of equivalents and other applicable judicial doctrines.

We claim:

1. A method for cleaning a spent anode assembly that has been expended in an aluminum reduction system, the spent anode assembly having a carbon butt attached to a stub and bath material crusted onto the carbon butt, the method comprising the following steps:

transporting the spent anode assembly to a first processing station;

vibrating the carbon butt at the first processing station to loosen and separate a first portion of crusted bath material from the carbon butt;

transporting the spent anode assembly from the first processing station to a second processing station;

scraping residual crusted material from the carbon butt at the second processing station;

transporting the spent anode assembly from the second processing station to a third processing station; and blowing gas onto the carbon butt to further remove crusted bath material remaining on the carbon butt at the third processing station.

2. A method as recited in claim 1, wherein said transporting steps comprise conveying the spent anode assembly using a conveyor system through the first, second, and third processing stations.

3. A method as recited in claim 1, wherein said vibrating step comprises the following steps:

moving the spent anode assembly through the first processing station; and vibrating the carbon butt while the spent anode assembly is being moved through the first processing station.

4. A method as recited in claim 1, wherein said vibrating step comprises the following steps:

dragging the carbon butt across a vibrating surface at the first processing station; and vibrating the carbon butt while the carbon butt is being dragged through the first processing station.

5. A method as recited in claim 1, wherein said blowing step comprises the following steps:

enclosing the carbon butt within a chamber at the third processing station; and blowing compressed gas onto the carbon butt.

6. A method as recited in claim 1, further comprising an additional step of collecting the crusted bath material after removal from the carbon butt.

7. A method for removing encrusted bath material from a carbon butt of a spent anode assembly, the method comprising the following steps:

dragging the carbon butt across a surface; and vibrating the surface while the carbon butt is being dragged across the surface to separate the encrusted bath material from the carbon butt.

8. A method as recited in claim 7, further comprising the following additional steps:

supporting the spent anode assembly in a hanging vertical position;

dragging the carbon butt up an inclined surface, causing the spent anode assembly to rotate from the vertical position to an angled position; and dragging the carbon butt across the surface with the spent anode assembly in the angled position.

9. A method as recited in claim 7, further comprising an additional step of collecting the encrusted bath material after removal from the carbon butt.

10. An anode rough cleaning system for cleaning a spent anode assembly that has been expended in an aluminum reduction system, the spent anode assembly having a carbon butt attached to a stub and bath material crusted onto the carbon butt, the anode rough cleaning system comprising:

a vibrating station having a vibrating surface for shaking the carbon butt to separate the crusted bath material from the carbon butt;

a scraping station downstream of the vibrating station, the scraping station having at least one scraper to scrape the crusted bath material from the carbon butt; and a blow-off station downstream of the scraping station, the blow-off station having at least one pressurized gas port directed to blow the crusted bath material off the carbon butt.

11. An anode rough cleaning system as recited in claim 10, wherein the scraping station has adjustable scrapers that mechanically move to scrape the crusted bath material from the carbon butt.

12. An anode rough cleaning system as recited in claim 10, further comprising a conveyor to move the spent anode assembly sequentially to the vibrating station, then to the scraping station, and then to the blow-off station.

13. An anode rough cleaning system as recited in claim 10, further comprising an overhead conveyor to move the spent anode assembly, the overhead conveyor supporting the spent anode assembly in a hanging vertical position with the carbon butt suspended therebeneath.

14. An anode rough cleaning system as recited in claim 13, wherein:

the vibrating station includes an inclined surface leading to the vibrating surface; and the overhead conveyor being arranged over the inclined and vibrating surfaces to drag the carbon butt up the inclined surface, causing the spent anode assembly to rotate from the vertical position to an angled position, and across the vibrating surface with the spent anode assembly in the angled position.

15. An apparatus for removing encrusted bath material from a carbon butt of a spent anode assembly, the apparatus comprising:

a vibrating station having a vibrating surface for shaking the carbon butt to separate the crusted bath material from the carbon butt and a conveyor to drag the carbon butt across the vibrating surface to separate the encrusted bath material from the carbon butt, a scraping station downstream of the vibrating station, the scraping station having at least one scraper to scrape the encrusted bath material from the carbon butt; and a blow-off station downstream of the scraping station, the blow-off station having at least one pressurized gas port directed to blow the encrusted bath material off the carbon butt.

16. An apparatus as recited in claim 15 wherein the vibrating surface is horizontal.

17. An apparatus as recited in claim 15 wherein the vibrating surface transports the encrusted bath material separated from the carbon butt to a collection bin.

18. An apparatus as recited in claim 15 wherein:

the conveyor moves the spent anode assembly in a first direction while dragging the carbon butt across the vibrating surface; and the vibrating surface transports the encrusted bath material separated from the carbon butt in a second direction toward a collection bin, the second direction being opposite to the first direction.

19. An apparatus as recited in claim 15, wherein the conveyor comprises an overhead conveyor which supports the spent anode assembly in a hanging vertical position with the carbon butt suspended therebeneath.

20. An apparatus as recited in claim 19, further comprising:

an inclined surface leading to the vibrating surface; and the overhead conveyor being arranged over the inclined and vibrating surfaces to drag the carbon butt up the inclined surface, causing the spent anode assembly to rotate from the vertical position to an angled position, and across the vibrating surface with the spent anode assembly in the angled position.

* * * * *